US007040505B2

(12) United States Patent
Hashimoto et al.

(10) Patent No.: US 7,040,505 B2
(45) Date of Patent: May 9, 2006

(54) MEDICINE FEEDER

(75) Inventors: Hiroshi Hashimoto, Toyonaka (JP); Tasuku Minami, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 76 days.

(21) Appl. No.: 10/495,226

(22) PCT Filed: Nov. 13, 2002

(86) PCT No.: PCT/JP02/11824

§ 371 (c)(1),
(2), (4) Date: May 11, 2004

(87) PCT Pub. No.: WO03/042042

PCT Pub. Date: May 22, 2003

(65) Prior Publication Data

US 2004/0245276 A1 Dec. 9, 2004

(30) Foreign Application Priority Data

Nov. 14, 2001 (JP) ..... 2001-348895

(51) Int. Cl.
*B65H 3/60* (2006.01)
*G07F 11/00* (2006.01)

(52) U.S. Cl. ..... 221/203; 221/258; 221/265

(58) Field of Classification Search ..... 221/258, 221/263, 265, 277, 154, 287
See application file for complete search history.

(56) References Cited

U.S. PATENT DOCUMENTS 3,785,525 A * 1/1974 Handeland ..... 221/265

(Continued)

FOREIGN PATENT DOCUMENTS

JP 61-179422 11/1986

(Continued)

OTHER PUBLICATIONS

Microfilm of the specification and drawings annexed to the request of Japanese Utility Model Application No. 63784/1985 (Laid-open No. 179422-1986) (Sharp Corp.), Nov. 8, 1986, Claims; Figs. 1 to 3.

(Continued)

*Primary Examiner*—Kathy Matecki
*Assistant Examiner*—Rakesh Kumar
(74) *Attorney, Agent, or Firm*—Wenderoth, Lind & Ponack, L.L.P.

(57) ABSTRACT

A tablet feeder that is simple in construction and yet capable of accurately preventing drawbacks from occurring due to jamming of medicine or the like. A motor (6) installed on a case support block (3) is driven to rotate a rotor (9) disposed in a medicine receiving case (1) through a plurality of gears. The tablets received in the medicine receiving case (1) are held in the pockets (10) of the rotor (9) and are moved to a discharge section (11) to discharge tablets therefrom. The gearing is composed of a driving gear (7) connected to the rotary shaft of the motor (6), and a driven gear (13) meshing with the driving gear (7). Installed in either of the power transmission paths extending from the motor (6) to the rotor (9) through the two gears (7, 13) is a power cut-off section (15, 17) that cuts off the power from the motor (6) when a force of a predetermined value or above acts on the rotor (9).

4 Claims, 6 Drawing Sheets

U.S. PATENT DOCUMENTS

| | | | | |
|---|---|---|---|---|
| 4,662,538 | A * | 5/1987 | Goudy et al. | 221/265 |
| 5,141,129 | A * | 8/1992 | Jennings | 221/154 |
| 5,383,559 | A * | 1/1995 | Toren | 206/533 |
| 5,667,096 | A * | 9/1997 | Wu | 221/6 |
| 5,671,592 | A | 9/1997 | Yuyama et al. | |
| 5,901,876 | A * | 5/1999 | Yuyama et al. | 221/133 |
| 6,073,799 | A * | 6/2000 | Yuyama et al. | 221/154 |
| 6,394,308 | B1 * | 5/2002 | Yuyama et al. | 221/265 |
| 6,405,893 | B1 * | 6/2002 | Tobe et al. | 221/2 |
| 6,471,090 | B1 * | 10/2002 | Inamura et al. | 221/124 |
| 6,585,132 | B1 * | 7/2003 | Kim | 221/133 |

FOREIGN PATENT DOCUMENTS

| | | |
|---|---|---|
| JP | 5-79731 | 10/1993 |
| JP | 8-119202 | 5/1996 |

OTHER PUBLICATIONS

CD-ROM of the specification and drawings annexed to the request of Japanese Utility Model Application No. 15380/1992 (Laid-open No. 79731/1993) (Kyocera Corp.), Oct. 29, 1993, Claims; Fig. 2.

* cited by examiner

MEDICINE FEEDER

BACKGROUND OF THE INVENTION

1. Technical Field

The present invention relates to a medicine feeder.

2. Description of Related Art

Conventionally, there has been a medicine feeder comprising a case supporting base provided with a motor and a medicine containing case removably mounted on the case supporting base. In this kind of medicine feeder, when the motor is driven to rotate a rotor provided in the medicine containing case via a plurality of gears, the medicine held in pocket portions formed on the rotor can be discharged from a discharge portion of the case supporting base.

In the conventional construction, however, when a medicine is jammed and the rotation of the rotor is prevented, there is a risk that the medicine may be damaged or the motor may suffer burnout.

SUMMARY OF THE INVENTION

Thus, a problem of the present invention is to provide a medicine feeder that is simple in construction and yet capable of accurately preventing drawbacks from occurring due to jamming of the medicine or the like.

As a means for solving the aforementioned problem, the present invention provides a medicine feeder in which a motor provided in a case supporting base is driven to rotate a rotor in a medicine containing case supported in the case supporting base via a plurality of gears. Medicine contained in the medicine containing case are held in each pocket portion of the rotor and are moved to a discharge portion of the case supporting base to discharge the medicine from the discharge portion.

The plurality of gears are composed of a driving gear connected to a rotation shaft of the motor and a driven gear engaging with the driving gear.

Also, a power cut-off portion is provided in a power transmission passage reaching the rotor from the motor through the both gears so that power from the motor is cut off when a braking force of more than a predetermined value acts on the rotor.

According to the above construction, in a case where medicine such as tablets, capsules and so on is jammed and rotation of the rotor is prevented, the power cut-off portion does not allow a drive power from the motor to be transmitted to the rotor, and thereby any disadvantages such as damage to the medicine, burnout of the motor and so on would not occur.

It is preferable in that a desired effect can be obtained in spite of a simple construction in which the power cut-off portion comprises a friction generating member provided between the rotor and the driven gear.

It is preferable in that damage to the medicine, motor burnout, and so on can be reliably prevented considering properties of the medicine so that a friction force generated by the friction generating member is adjustable.

The friction generating member may comprise a ring member having an annular shape, and the ring member can be made of synthetic resin material.

The power cut-off portion may comprise indentations provided on either one of the rotor and the driven gear and protrusions provided on the other. The protrusions engage with the indentations such that the engagement of the indentations and the protrusions is released when a braking force of more than a predetermined value acts on the rotor.

According to the present invention, as the power cut-off portion is provided in the power transmission passage reaching the rotor from the motor, it is possible to reliably prevent any disadvantages such as damage to the medicine, burnout of the motor, and so on even if the medicine jam or so disables the motor from rotating.

DETAILED DESCRIPTION OF THE INVENTION

Hereinafter, embodiments according to the present invention will be explained with reference to the accompanying drawings.

Figure 1:
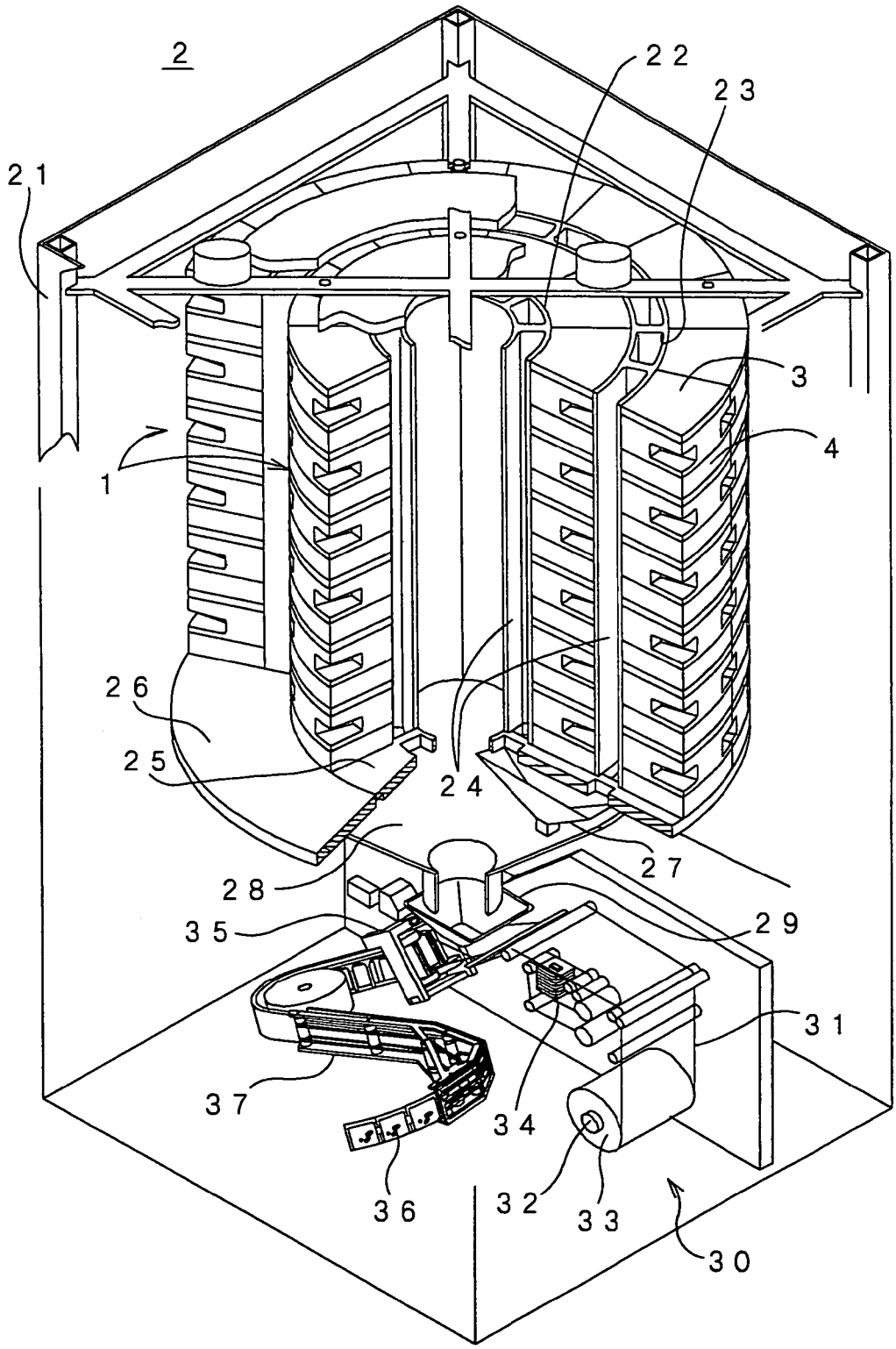
FIG. 1 is a front view of a tablet feed apparatus provided with a tablet feeder according to an embodiment of the present invention.

FIG. 1 shows a tablet feed apparatus 2 having a plurality of tablet feeders 1 according to the present invention.

In the tablet feed apparatus 2, inner and outer double drums 22, 23 are contained inside a cabinet 21 with the upper and lower end rotatably supported. On the outer surface of each drum 22, 23 are provided the plurality of tablet feeders 1, while on the inner surface are formed a plurality of drop guide passages 24 in which the tablets discharged from each tablet feeder 1 provided in a vertical direction drop. Beneath the drums 22, 23 are provided lower plates 25, 26 having shutters (not shown) for temporarily receiving the tablets dropping from each drop guide passage 24. Under the lower plates 25, 26 are provided small hoppers 27 corresponding to each drop guide passage 24. Each small hopper 27 receives the tablets dropping from the drop guide passages 24 of the inner drum 22 and the drop guide passages 24 of the outer drum 23. Under the small hoppers 27 is provided a collection hopper 28 for collecting the tablets dropping from the small hoppers 27. Beneath the collection hopper 28 is provided a packing hopper 29. Under the packing hopper 29 is provided a tablet packing section 30.

The tablet packing section 30 comprises a roll 33 comprising a wound packing sheet 31 that is removably mounted on a roll shaft 32, a printer 34 for printing information such as patient name, tablet name, dosing time, dose and the like on the packing sheet 31 reeled out from the roll 33, a triangle plate (not shown in detail) for folding the packing sheet 31 into two so that the tablets discharged from the packing hopper 29 can be introduced, a pair of heater rollers 35 for sealing the packing sheet 31 with the introduced tablets, and a conveyor 37 for conveying the medicine package belt 36, which has passed through the heater rollers 35 and has been discharged in an oblique lower direction, in an oblique upper direction to direct it to a discharge port (not shown).

Figure 2:
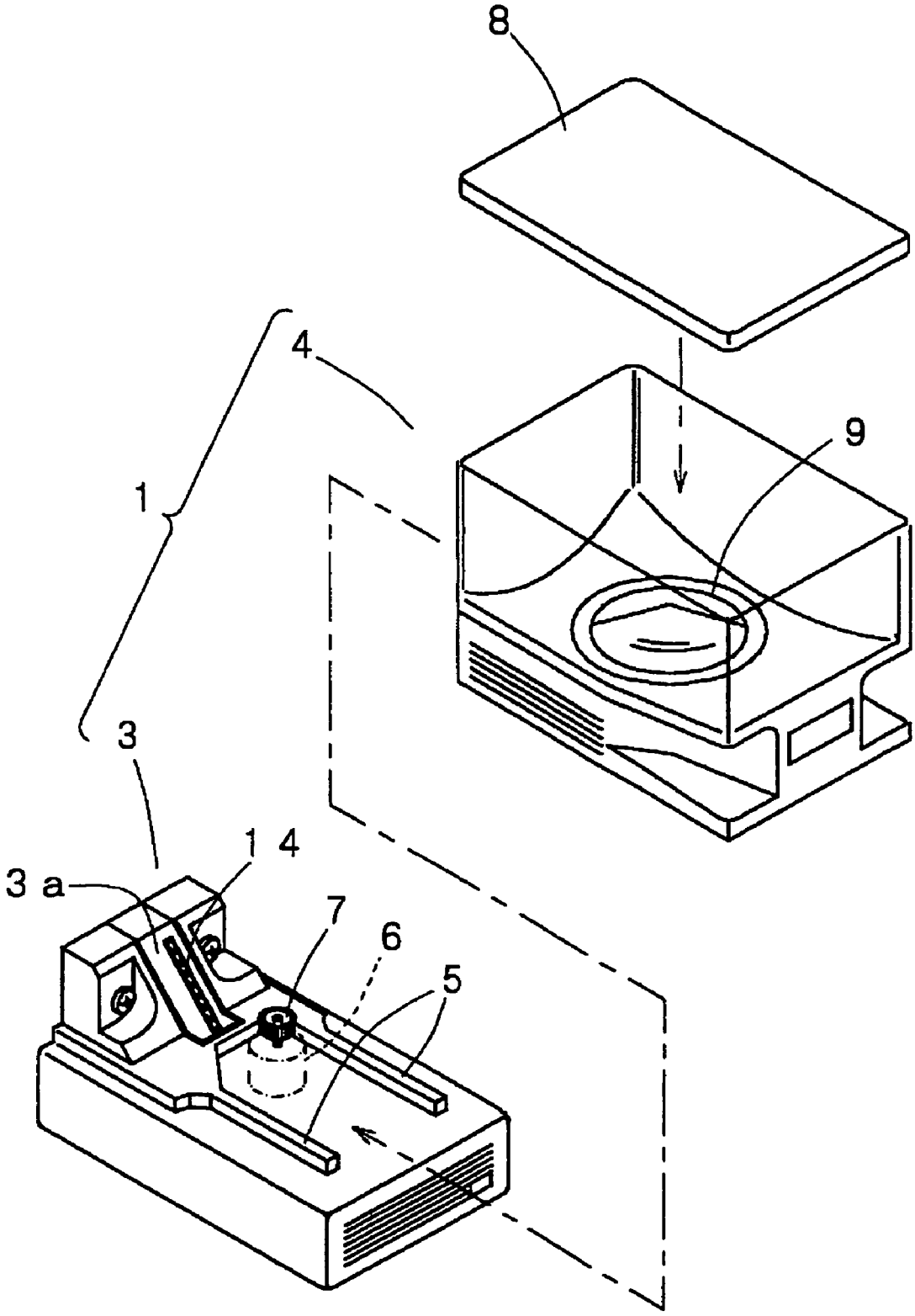
FIG. 2 is an exploded perspective view of the tablet feeder according to an embodiment of the present invention.
Figure 3:
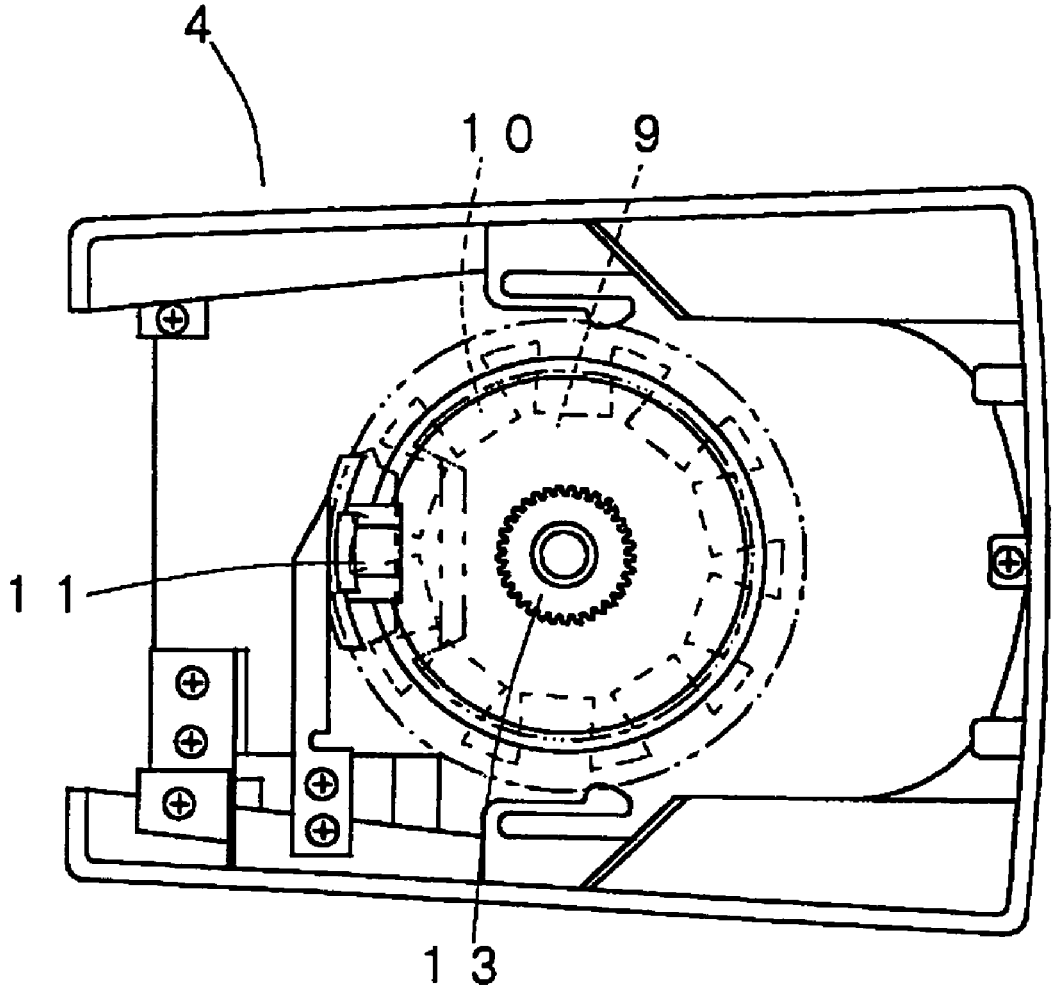
FIG. 3 is a bottom view of the tablet containing case shown in FIG. 2.

The tablet feeder 1, as shown in FIG. 2, is constituted by a case supporting base 3 provided on the tablet feed apparatus 2 and a tablet containing case 4 removably mounted on the case supporting base 3.

The case supporting base 3 is provided with guide portions 5 on the upper surface side by side with a predetermined distance. Inside the case supporting base 3 is housed a motor 6 which is driven and controlled based on a control signal from a control unit (not shown). The rotation shaft of the motor 6 protrudes from the upper surface of the case supporting base 3. On the protruding portion is integrated a driving gear 7. The case supporting base 3 is formed with a discharge passage 3*a* in which a sensor 14 is provided for detecting the tablets passing therethrough.

Figure 4:
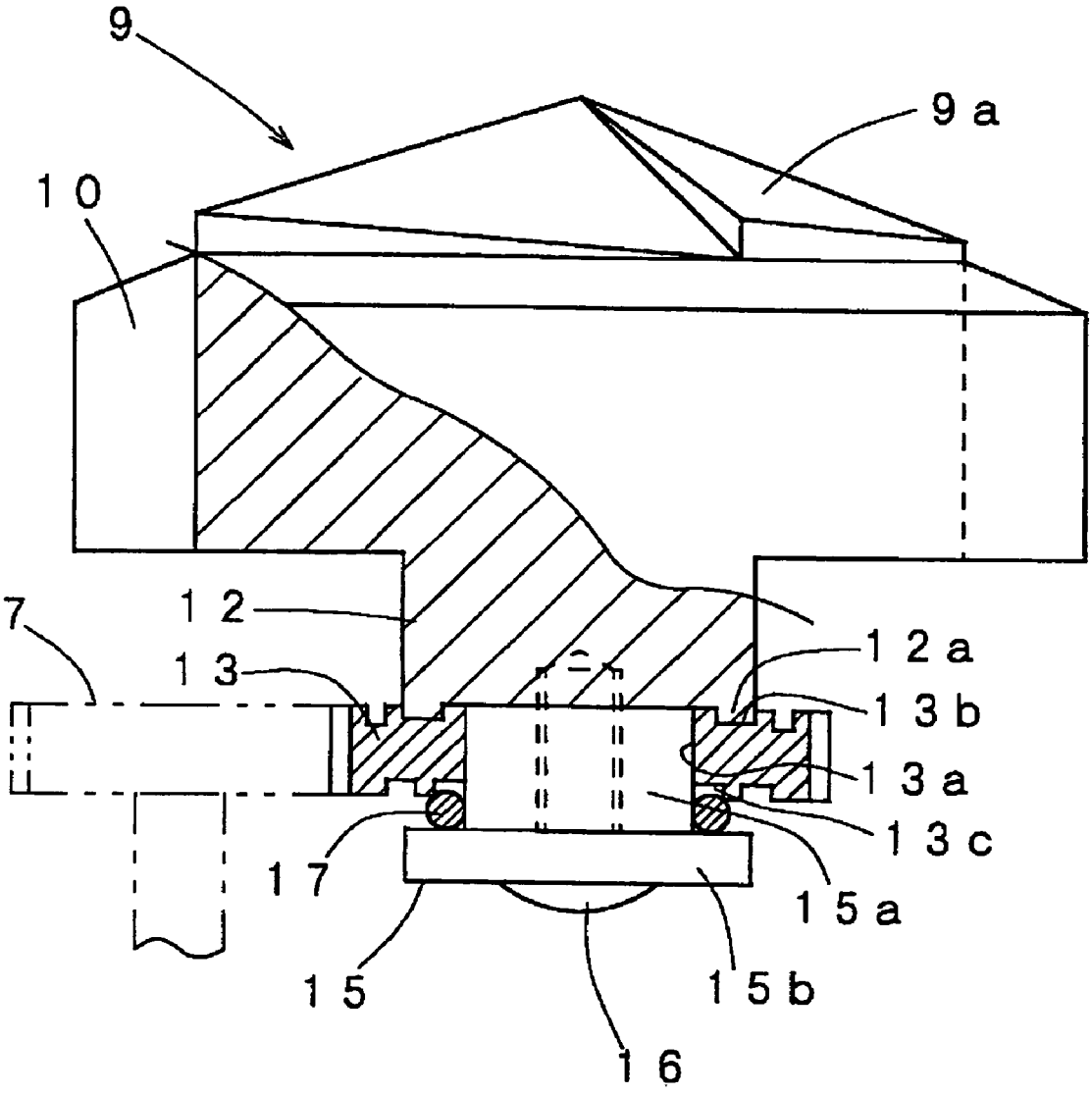
FIG. 4 is a partly sectional view of a rotor of the tablet feeder shown in FIG. 2.

The tablet containing case 4 has a substantially box-like shape, the upper surface of which can be opened and closed by a lid 8. The upper surface of the bottom wall of the tablet containing case 4 is formed in a substantially conical shape, in which a rotor 9 is provided. The upper surface of the rotor 9, as shown in FIG. 4, has, a substantially conical shape and is formed with step portions 9*a* which gradually protrude at three equally spaced portions in a circumferential direction. On the outer surface of the rotor, pocket portions 10, each of which has a groove shape extending in a vertical direction, are formed at a plurality of positions spaced with an equal angle. The pocket portion 10 has a width and depth that makes it possible to hold only one tablet contained in the case 4. The bottom wall of the tablet containing case 4 is formed with a discharge port 11. The discharge port 11 has a width dimension that permits the port to register with only one of the pocket portions 10 of the rotor 9. The central portion of the bottom surface of the rotor 9 is provided a rotation shaft 12. The rotation shaft 12 protrudes from the lower surface of the bottom wall of the tablet containing case 4. On the outer periphery of the end surface of the rotation shaft 12 is formed an annular protruding portion 12*a*.

A driven gear 13 is attached, by an attachment member 15, to the rotation shaft of the rotor 9. The attachment member 15 comprises a shaft portion 15*a* and a flange portion 15*b* and is fixed on the rotation shaft 12 of the rotor 9 with a screw 16 inserted into the central portion of the attachment member 15. The shaft portion 15*a* is inserted into a central aperture 13*a* of the driven gear 13 to rotatably support the driven gear 13. The flange portion 15*b* supports the driven gear 13 between the flange portion 15*b* and the end surface of the rotation shaft of the rotor 9 via a ring member 17. The ring member 17 comprises, for example, an O-ring made of synthetic resin and generates a predetermined friction force in accordance with a gap between the rotor 9 and the attachment member 15, i.e., a press contact force with the ring member 17. A friction force is set so that when a tablet jam prevents the rotor 9 from rotating, a slip can be caused between the ring member 17 and the rotor 9 or the attachment member 15 before the tablet suffers damage such as a break or split. The driven gear 13 is made of synthetic resin material. On the upper surface of the driven gear 13 is formed an annular groove 13*b* with which the annular protruding portion 12*a*, which is formed on the rotation shaft 12 of the rotor 9, rotatably engages. On the lower opening edge portion is formed an annular recess portion 13*c* in which the ring member 17 is positioned. Annular grooves formed on the outer periphery of the upper and lower surfaces of the driven gear 13 are provided as a so called relief in order to make the thickness equal.

Operation of the tablet feeder 1 of the above construction will be explained hereinafter.

In accordance with a prescription data, the tablet feeder 1 containing the specified tablets is driven. That is to say, when the motor 6 is driven, drive power is transmitted to the driven gear 13 via the driving gear 7. To the attachment member 15 from the driven gear 13, the drive power is transmitted by a friction force against the ring member 17 positioned between the both members. Thus, rotation of the driving gear 7 allows the attachment member 15, the driven gear 13 and the rotor 9 to rotate via the ring member 17 so that tablets held in the pocket portions 10 can be discharged from the discharge passage 3*a* one after another. The number of discharged tablets is counted by the sensor 14 provided in the discharge passage 3*a*. When the discharged number reaches a predetermined number, the motor 6 is stopped.

For example, when a tablet jam prevents the rotor 9 from rotating and a braking force acts on the rotor 9, a slip is caused between the attachment member 15 and the driven gear 13 so that a drive power of the motor 6 is cut-off. Therefore, no excessive load acts on the jammed tablet from the rotor 9 and the tablet does not suffer damage such as breakage or splitting.

The tablets discharged from each tablet feeder 1 fall on the lower plates 25, 26 through the drop guide passages 24. When a shutter (not shown) is opened at a predetermined timing, the tablets are introduced into the tablet packing section 30 through the small hoppers 27, the collection hopper 28 and the packing hopper 29, and are then packed by one dose in the tablet packing section 30.

Figure 5:
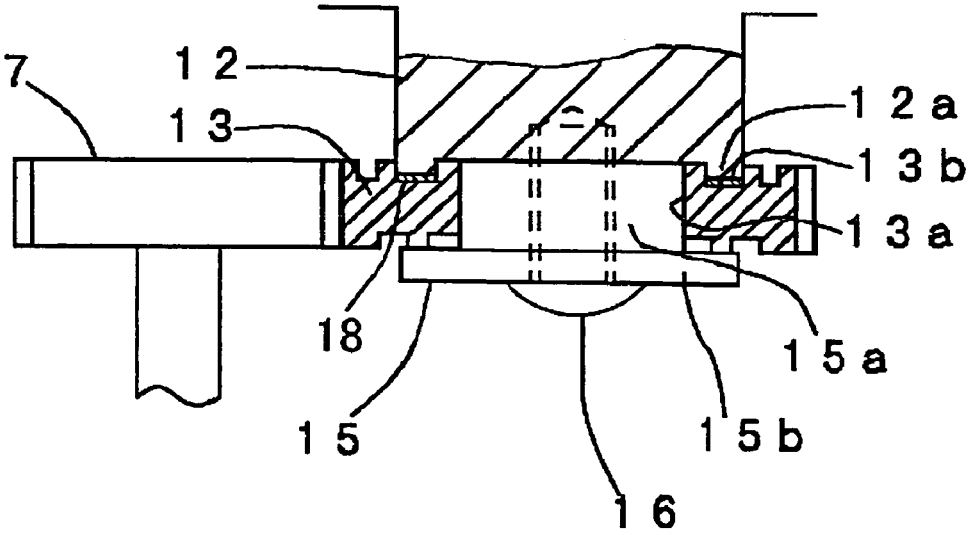
FIG. 5 is a partly sectional view of a variation of the tablet feeder of FIG. 4.

In the aforementioned embodiment, the O-ring is used as the ring member 17 but the shape, material and so on of the ring member 17 is not limited to this. For example, as shown in FIG. 5, it is also possible to stick a ring-like rubber sheet 18 etc. on at least one of the contact surfaces between the driven gear 13 and the rotation shaft of the rotor 9 to change the friction coefficient.

Figure 6:
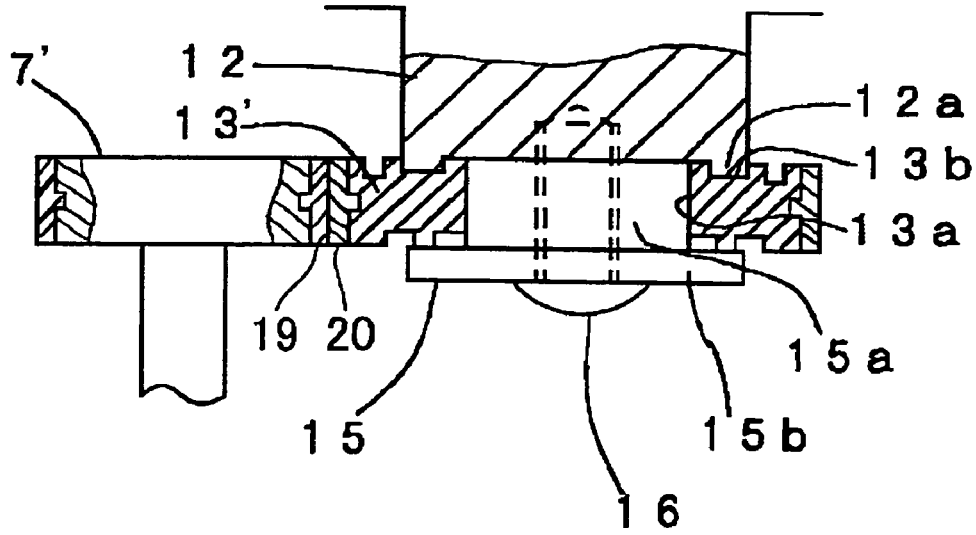
FIG. 6 is a partly sectional view of an another variation of the tablet feeder of FIG. 4.

Furthermore, in the aforementioned embodiment, the ring member 17 etc. is interposed between the rotor 9 (and the attachment member 1) and the driven gear 13 to cause a slip, though the same construction may be used between the rotation shaft of the motor 6 and the driving gear 7. Also, instead of the driving gear 7 and the driven gear 13, as shown in FIG. 6, rollers 7', 13' with rubbers 19, 20 attached on the outer surface thereof may be used so that the rubbers can come into contact with each other to cause a slip therebetween.

Furthermore, in the aforementioned embodiment, the attachment member 15 is attached by means of the screw 16, though it is preferable in that the friction force against the ring member 17 be made adjustable forming a male screw on the outer end surface of the shaft portion 15*a* of the attachment member 15 and directly screw it into the rotor 9.

In the aforementioned embodiment, as a power cut-off means of the present invention, a friction forming member such as the ring member 17, the rubber sheet 18, the rubbers 19, 20 and so on is used, though indentations may be provided on either one of the rotor 9 (or attachment member 15) and the driven gear 13 while protrusions that engage with the indentation may be provided on the other so that when a braking force of more than a predetermined value acts on the rotor 9, engagements of the indentations and the protrusions are released and the drive power is cut-off.

Figure 7:
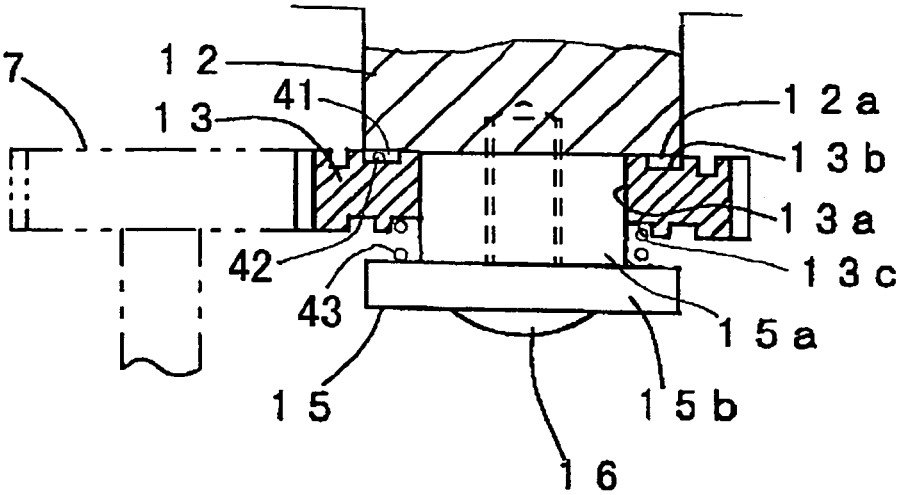
FIG. 7 is a partly sectional view of a rotor of the tablet feeder according to an another embodiment of the present invention.
Figure 8:
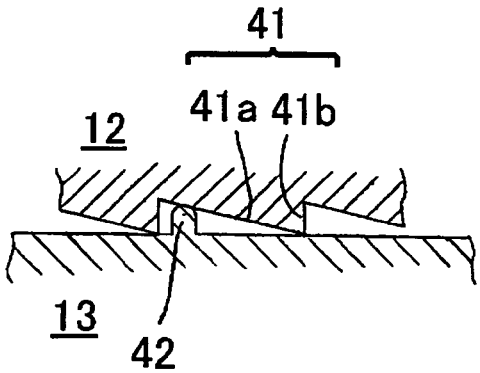
FIG. 8 is a partly enlarged sectional view of the rotor of FIG. 7.

For example, as shown in FIG. 7, indentations 41 are formed on the annular protruding portion 12*a* of the rotation shaft 12 of the rotor 9 while protrusions 42 which engage with the indentations 41 may be formed on the annular groove 13*b* of the driven gear 13. A spring 43 may be provided between the annular recess portion 13*c* of the driven gear 13 and the flange portion 15*b* of the attachment member 15 to urge the driven gear 13 upward so that the engagement of the indentations 41 and the protrusions 42 can be maintained. The indentations 41, as shown in FIG. 8, comprise a plurality of slopes 41*a* and step portions 41*b* which are continuously formed in a circumferential direction. In normal operation, the engagement of the indentations 41 and the protrusions 42 allows the drive power of the motor 6 to be transmitted to the rotor 9 from the driven gear 13. When a tablet jam causes a braking force of more than a predetermined value to act on the rotor 9, the protrusions 42 slide on the slopes of the indentations 41 and overpass the step portions 41*b* as the driven gear 13 moves downward, and thereby the drive power of the motor 6 can be cut-off.

Figure 9:
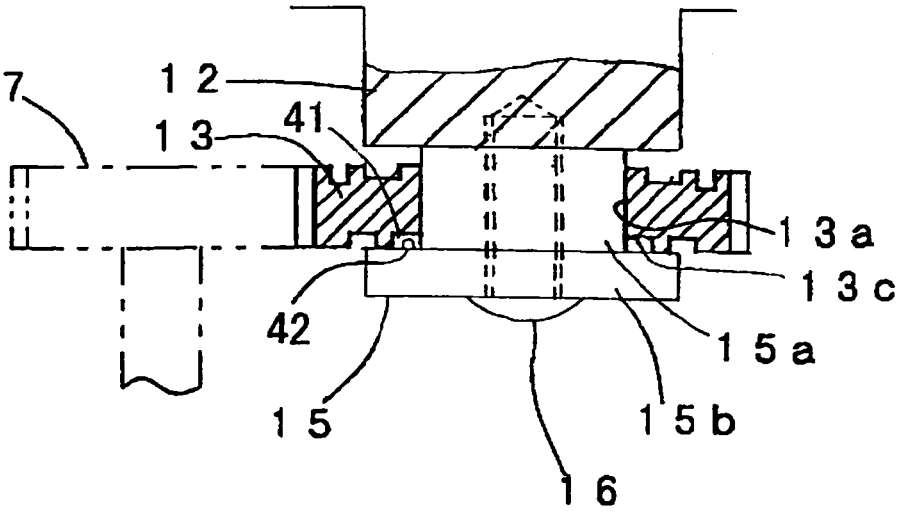
FIG. 9 is a partly sectional view of a variation of the tablet feeder of FIG. 7.

Moreover, as shown in FIG. 9, indentations 41 may be formed on the annular recess portion 13*c* of the driven gear 13 while protrusions 42, which engage with the indentations 41, may be formed on the flange portion 15*b* of the attachment member 15. In this case, as the engagements of the indentations 41 and the protrusions 42 are maintained by the weight of the driven gear 13, the spring shown in FIG. 7 is not necessary.

In the aforementioned embodiment, although the construction of discharging tablets as medicine has been described, other solid types of medicine such as capsules can be dealt with by the same construction.

The invention claimed is:

1. A medicine feeder comprising:

a medicine containing case having a rotor defining a plurality of pocket portions;

a case supporting base for supporting the medicine containing case, said case supporting base including a motor for rotatably driving the rotor via a plurality of gears, wherein each pocket portion of the rotor is capable of receiving medicine from the medicine containing case, and moving the medicine to a discharge portion of the case supporting base to discharge the medicine from the discharge portion, wherein said plurality of gears comprise a driving gear connected to a rotation shaft of the motor and a driven gear engaging the driving gear; and a power cut-off portion provided in a power transmission passage reaching the rotor from the motor through the driving and driven gears so that power from the motor will be cut off from the rotor when a braking force of more than a predetermined value acts on the rotor, wherein the power cut-off portion comprises a friction generating member provided between the rotor and the driven gear, and wherein the friction generating member comprises: a shaft portion fixed to the rotor and rotatably supporting the driven gear; a ring member having an annular shape and being made of synthetic resin material; and a flange portion for supporting the ring member between the flange portion and the driven gear.

2. The medicine feeder as claimed in claim 1, wherein a friction force generated by the friction generating member is adjustable.

3. A medicine feeder comprising:

a medicine containing case having a rotor defining a plurality of pocket portions;

a case supporting base for supporting the medicine containing case, said case supporting base including a motor for rotatably driving the rotor via a plurality of gears, wherein each pocket portion of the rotor is capable of receiving medicine from the medicine containing case, and moving the medicine to a discharge portion of the case supporting base to discharge the medicine from the discharge portion, and wherein said plurality of gears comprise a driving gear connected to a rotation shaft of the motor and a driven gear engaging the driving gear; and a power cut-off portion provided in a power transmission passage reaching the rotor from the motor through the driving and driven gears so that transmission of power from the motor will be cut off from the rotor when a braking force of more than a predetermined value acts on the rotor, wherein the power cut-off portion comprises indentations provided on one of the rotor and the driven gear, and protrusions provided on the other of the rotor and the driven gear, wherein the engagement of the indentations and the protrusions is released when a braking force of more than a predetermined value acts on the rotor.

4. A medicine feeder comprising:

a medicine containing case having a rotor defining a plurality of pocket portions;

a case supporting base for supporting the medicine containing case, said case supporting base including a motor for rotatably driving the rotor via a power transmission mechanism comprising a driving roller and a driven roller, said driving roller being connected to a rotation shaft of the motor, wherein each pocket portion of the rotor is capable of receiving medicine from the medicine containing case, and moving the medicine to a discharge portion of the case supporting base to discharge the medicine from the discharge portion, wherein the driving roller has a rubber member attached to an outer surface thereof, the driven roller has a rubber member attached to an outer surface thereof, and the rubber member of the driving roller is in engagement with the rubber member of the driven roller, and wherein, when a braking force of more than a predetermined value acts on the rotor, a slip is caused between the respective rubber members to effectively cut-off transmission of power from the motor.

* * * * *